US009191135B2

(12) United States Patent
Englert

(10) Patent No.: US 9,191,135 B2
(45) Date of Patent: Nov. 17, 2015

(54) CONTACT INFORMATION RECOGNITION SYSTEM FOR EXTERNAL TEXTUAL DATA DISPLAYED BY IN-VEHICLE INFOTAINMENT SYSTEMS

(71) Applicant: FORD GLOBAL TECHNOLOGIES, LLC, Dearborn, MI (US)

(72) Inventor: Richard Englert, South Lyon, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 149 days.

(21) Appl. No.: 13/834,774

(22) Filed: Mar. 15, 2013

(65) Prior Publication Data

US 2014/0273908 A1 Sep. 18, 2014

(51) Int. Cl.

| | |
|---|---|
| ***H04H 60/37*** | (2008.01) |
| ***H04H 20/93*** | (2008.01) |
| ***H04H 60/73*** | (2008.01) |
| ***H04H 60/74*** | (2008.01) |
| *H04H 40/27* | (2008.01) |

(52) U.S. Cl.

CPC ..... *H04H 60/37* (2013.01); *H04H 20/93* (2013.01); *H04H 60/73* (2013.01); *H04H 60/74* (2013.01); *H04H 40/27* (2013.01)

(58) Field of Classification Search

USPC ..... 455/3.01, 3.04, 3.06, 414.1, 66.1, 455/550.1, 575.1, 185.1, 186.1, 345, 501, 455/503

See application file for complete search history.

(56) References Cited

U.S. PATENT DOCUMENTS

| | | | | |
|---|---|---|---|---|
| 7,340,249 | B2 | 3/2008 | Moran et al. | |
| 8,401,580 | B2 * | 3/2013 | Anzures et al. | 455/503 |
| 8,521,078 | B2 * | 8/2013 | Mittal et al. | 455/3.01 |
| 2002/0183102 | A1 * | 12/2002 | Withers et al. | 455/186.1 |
| 2005/0054286 | A1 | 3/2005 | Kanjilal et al. | |
| 2006/0128418 | A1 | 6/2006 | Quelle et al. | |
| 2007/0248055 | A1 | 10/2007 | Jain et al. | |
| 2011/0065402 | A1 | 3/2011 | Kraft et al. | |

FOREIGN PATENT DOCUMENTS

| | | | |
|---|---|---|---|
| WO | WO-0150650 | A1 | 7/2001 |

* cited by examiner

*Primary Examiner* — Thanh Le

(74) *Attorney, Agent, or Firm* — Frank A. MacKenzie; Brooks Kushman, P.C.

(57) ABSTRACT

A media content processor system including a control unit configured to receive radio data including metadata and media content and to identify an element of the actionable content based on parsing data fields of the metadata tagged as including elements of data other than the actionable content, and a method of identifying the same. The metadata represents actionable content for presentation to a user. The method includes receiving radio data, identifying an element of the actionable content included in the metadata of the radio data, generating an option, and providing the option to the display screen.

23 Claims, 6 Drawing Sheets

CONTACT INFORMATION RECOGNITION SYSTEM FOR EXTERNAL TEXTUAL DATA DISPLAYED BY IN-VEHICLE INFOTAINMENT SYSTEMS

BACKGROUND

Radio has adapted to the digital media environment by including additional data, in the form of text strings, in the radio signals of terrestrial, satellite and HD radio broadcasts. The Radio Data System (RDS) is one example of a communications protocol standard for including digital information in a radio signal. The communications protocol may provide for the labeling of data and other information contained within the additional radio data through the use of tags or data fields, e.g., "Artist," "Title," etc. When a compatible terrestrial, satellite or HD radio receiver is tuned to a radio signal that is transmitting additional radio data within the signal, such as RDS data, the radio will display the tagged data on fields of a display screen according to the tagging. For instance, the data tagged as "Artist" may be displayed within an "Artist" field of the display screen. In the event the information is too large to all fit on the graphical display screen at the same time, the text will scroll across the graphical display screen.

As the manner in which individuals utilize technology continues to expand, broadcast radio has expanded the amount and types of radio data included in the additional radio data to include contact information, e.g., phone number, e-mail address, and social media information. As an example, a radio show may provide a call-in phone number in artist and song fields of additional radio data to allow listeners to be informed of the number on their graphical display screens. Presently there is no uniform standard for radio broadcasters to tag the text transmitted in radio data as including contact information. Thus, while contact information included in tagged information may be displayed by the radio as text, the included information will not be recognized as being contact information by the receiver.

SUMMARY

The present disclosure is generally directed toward a vehicle system which includes a receiver configured to receive radio data including media content and metadata descriptive of the media content, a control unit configured to identify an element of actionable content included in the metadata, and a display screen configured to display an option indicative of the element of the actionable content. The control unit, according to the present disclosure, may be configured to identify an element of actionable content associated with a data type-specific user interface action based on parsing data fields of the metadata tagged as including elements of data other than the actionable content.

The present disclosure is also generally directed toward a method of receiving radio data, wherein the radio data includes media content and metadata descriptive of the media content and identifying an element of actionable content. The method includes receiving radio data; identifying an element of the actionable content; and in response to identifying an element of the actionable content, generating an option to be displayed on a display screen.

The present disclosure is also generally directed toward a non-transitory computer-readable medium tangibly embodying computer executable instructions that when executed by a processor are configured to cause the processor to analyze the media content and metadata included in the radio data, determine whether an element of actionable content has been received, and display an option based on the element of actionable content.

BRIEF DESCRIPTION OF THE DRAWINGS

The foregoing will be apparent from the following more particular description of example embodiments of the invention, as illustrated in the accompanying drawings, wherein.

DETAILED DESCRIPTION

Phone numbers, e-mail addresses, social media accounts, and web addresses are just a few of the many types of content that may be included as text strings in radio data. These and other types of content information included in text strings of radio data may be referred to herein as actionable content.

Figure 1:
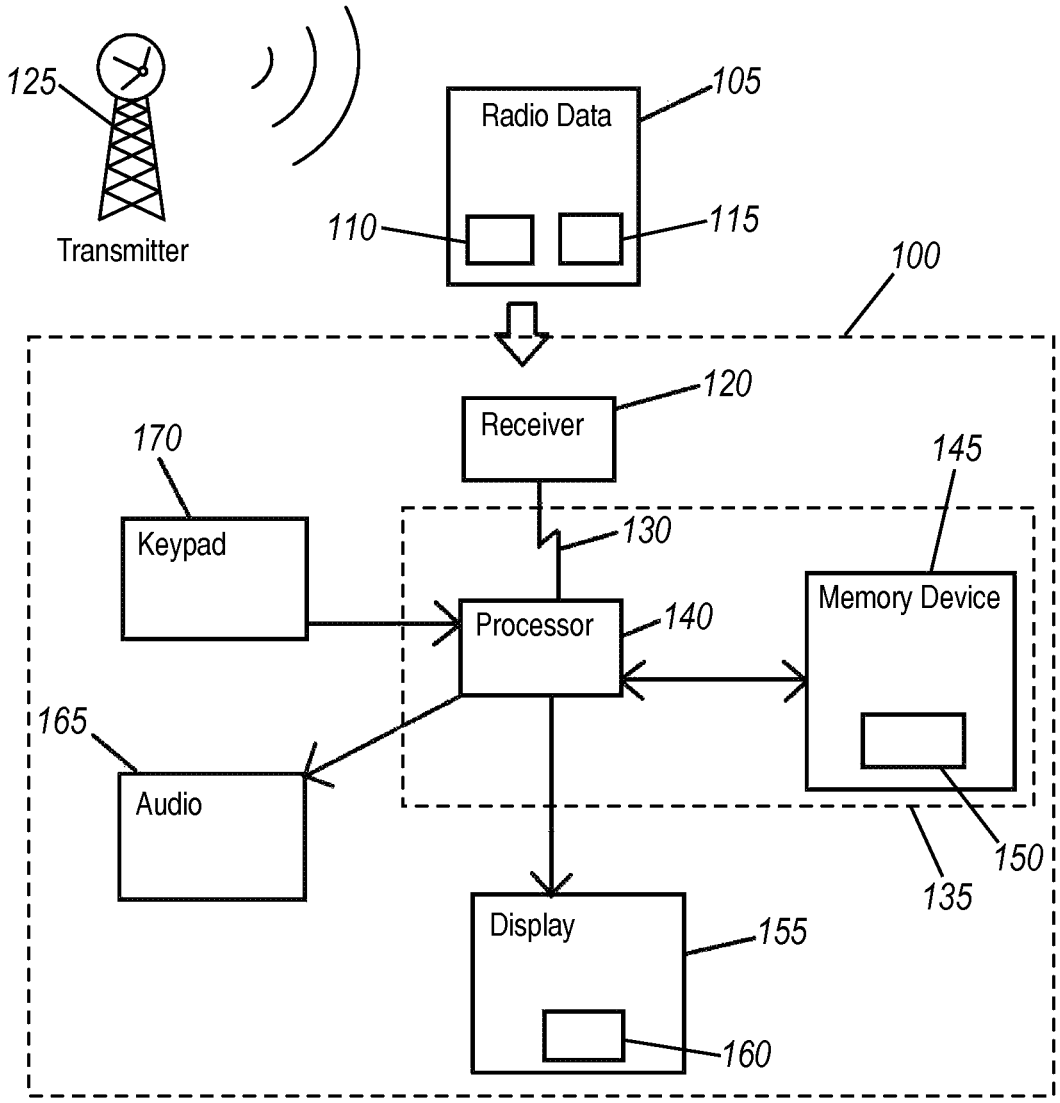
FIG. 1 illustrates a vehicle system configure to identify and display an element of actionable content.

FIG. 1 illustrates an exemplary vehicle system 100 configured to identify elements of actionable content and provide options 160 in a user interface to allow a user to interact with the actionable content. In FIG. 1, a vehicle system 100, having a receiver 120, control unit 135, and display screen 155, receives radio data 105 including media content 110 and metadata 115 descriptive of the media content 110 from a transmitter 125. The control unit 135 may include a processor 140 and a memory device 145 and may be in communication with a number of peripheral devices, such as an audio subsystem 165 and a keypad 170. The system may take many different forms and include multiple and/or alternate components and facilities. The exemplary components illustrated in the Figures are not intended to be limiting. Indeed, additional or alternative components and/or implementations may be used.

The vehicle system 100 may be included as a feature of any type of passenger or commercial vehicle, such as a car, truck, sport utility vehicle, cross-over vehicle, van, minivan, tractor-trailer, or the like. Moreover, the vehicle system 100 may be included as a feature of other types of vehicles such as a motorcycle, boat, or locomotive.

The radio data 105 may include media content 110 and metadata 115 descriptive of the media content 110. The media content 110 may include audio programming such as music or talk shows or in some cases visual data such as television programming or other video. The metadata 115 may be in the form of a text string, and may include data fields such as an "artist" field or a "title" field for presentation to a user. In some cases, metadata 115 may include elements of actionable content within the fields.

The receiver 120 may be configured to receive radio data 105 from a transmitter 125. As some examples, the receiver 120 may be configured to receive radio data 105 transmitted from a terrestrial, satellite, or on-demand media source. The receiver 120 may be further configured to communicate the media content 110 and metadata 115 across a network 130, such as a controller area network (CAN), to the control unit 135.

The control unit 135 may be configured to provide computing services to the occupants of the vehicle. The processor 140, embodied in the control unit 135, may be configured to receive various inputs and generate outputs based on the inputs received or computer executable instructions stored in a memory device 145. The processor 140 may be in communication with a memory device 145 configured to store CPU-executable program code, such as the instructions of a pattern recognition module 150. The control unit 135, executing the instructions of the pattern recognition module 150 on a processor 140, may be configured to identify an element of actionable content associated with a data type-specific user interface action based on parsing data fields of the metadata 115 included in the radio data 105 and tagged as including elements of data other than the actionable content. Exemplary types of actionable content identifiable by the control unit 135 may include phone numbers, web addresses, short codes, commonly used phrases, social media network address, and e-mail addresses.

With respect to identification of an element of actionable content representing a phone number, the control unit 135 may identify a potential area code in the metadata 115. For example, the control unit 135 may be configured to identify an element including a string of three numeric characters. Due to variations in how phone numbers may be written, the area code may be recognized in various formats, such as with or without surrounding parentheses or other additional characters. Once identified, the area code string may be validated against a listing of valid area codes. For instance, the area code string may be validated against a stored listing of valid in-use North American Numbering Plan (NANP) area codes. Certain valid area codes may be specifically excluded, however, such as N11 codes which may be inappropriate for dialing by the vehicle system 100. As some specific examples: each of "800", "(888)", "313", and "<425>" may be matched because they correspond to valid and in-use NANP area codes; each of "045", "999", "134", and "698" may not be matched because they correspond to invalid NANP area codes; each of "987", "261", "426", and "333" may not be matched because they may be valid area codes, but they are presently unused according to current revisions of the NANP; and each of "211", "311", "411", and "911" may not be matched because they correspond to reserved N11 codes that are not used for phone numbers.

Upon identifying a valid area code, the control unit 135 may be further configured to identify whether the characters following the area code complete a valid phone number. For instance, the control unit 135 may be configured to identify that seven numerals following a valid area code complete a valid phone number. These seven numerals may be accepted in various formats, such as arranged in one to three groups of numerals, where each group of numerals may be separated by up to three characters of whitespace and/or non-alphanumeric characters (e.g., separated by combinations of dashes, dots, and/or whitespace). As some examples, each of "4567890", "265-3423", "651.51.51", and "897-23-23" may be matched as completing a valid phone number. If the element following the valid area code includes numbers and alphabetic characters or alphabetic characters with no numerals, the control unit 135 may be configured to tolerate more than seven characters and still identify the element as a phone number. For instance, each of "WE-GOT-ED", "DR.LAURA", and "55 Sports" may also be matched as completing a valid phone number.

In some cases, the control unit 135 may be over-inclusive, and may incorrectly identify metadata 115 as including a phone number when the metadata 115 actually does not. Accordingly one or more techniques may be used to filter out false positive identifications of phone numbers.

One exemplary technique to reduce false positives may be for the control unit 135 to compare an element of actionable content identified as a phone number against the radio station frequency or station name of the broadcaster transmitting the radio data 105, based on an observation that such numerals are likely representative of the radio station and not of a phone number. For example, metadata 115 including the string "939 The River Radio" broadcast on 93.9 FM may be filtered out even though "939 The River" may otherwise meet the system criteria for matching a valid phone number. As another example, metadata 115 including "760 WJR—Your source for talk" broadcast on 760 AM may be filtered out even though "760 WJR—Your" may otherwise meet the system criteria for matching a valid phone number.

Another exemplary technique for reducing false positives may be for the control unit 135 to optionally be configured to compare the element of actionable content identified as a phone number against a list of known false positive string values, such that if any of the known false positive string values are found in the element of actionable content, then that element may be filtered out. Exemplary false positive strings may include "939 The River Radio", "810 in NY City", and "867-5309/JENNY" as some non-limiting examples. The control unit 135 may be configured with a list of known false positive elements that may be stored in a memory device 145 of the control unit 135. This list may be initially configured by a manufacturer or software provider of the vehicle, receiver, or control unit 135, as some examples. In some cases the control unit 135 may be configured to update the list of known false positives by connecting to an update server by way of a network connection, such as by way of a modem included in the vehicle or according to a network connection of a mobile phone or other Internet-enabled device paired with the control unit 135.

As yet another exemplary technique for reducing false positives, the control unit 135 may optionally be configured to compare the element identified as a phone number against the local area codes based on an identified physical location of the vehicle system 100 (e.g., identified according to a vehicle GPS receiver). For example, a control unit 135 of a vehicle system 100 located near Detroit, Mich. may identify the numeric string "313" as a valid area code but may filter the numeric string "415" out, while a control unit 135 of a vehicle system 100 located near Seattle, Wash. may identify the numeric string "415" as a valid area code but may filter the numeric string "313" out. The control unit 135 may be configured with a distance (e.g., 250 miles, 500 miles) or other metric (e.g., time zone, area code of phone number associated with the vehicle) to be used to determine how far the GPS location of the vehicle system 100 may be from an area code in the identified element of actionable content for the element to be filtered out. For radio data 105 being broadcast from a satellite or other type of source covering a relatively wide geographic area as compared to a terrestrial radio station, the control unit 135 may be configured to ignore filtering according to physical location.

Utilizing these techniques, the control unit 135 may be configured to identify various elements of metadata 115 as valid phone numbers. As some examples: "800 123 4567" may be matched as a basic case of a fully numeric phone number with no additional text; "(888) DRLAURA" may be matched as a phone number with parenthetical area code and alphabetic digits; "800 NASCAR-NOW" may be matched as phone number that is not completely numeric and therefore able to tolerate additional characters after an area code in excess of seven digits; "877-WE-GOT-ED" may be matched as an example of a phone number including multiple digit groups with multi-character non-alphabetic group separators; "Let's talk football! 800-NFL-TALK" may be matched despite having additional text before or after an otherwise valid phone number. As some counterexamples: "4251245623" may be rejected as lacking separation of the area code from the rest of the phone number by a non-alphanumeric character, making it relatively unlikely to be a phone number; and "989 AMP RADIO" may be rejected if broadcast on 98.9 FM (but may be allowable on another radio station), as the 989 may be more likely to be a station promotion than a phone number, despite the area code being potentially valid.

If the control unit 135 identifies an element of metadata 115 as being a valid phone number, the control unit 135 may be configured to generate an option 160 to be provided to the display screen 155 to allow a user to interact with the identified phone number. Exemplary display options 160 for a phone number may include, as some examples, an option 160 that when selected calls the phone number, and an option 160 that when selected allows for adding the phone number to an address book. The display screen 155 may in turn be configured to display the generated option 160 in a matter identifying the option 160 as a selectable phone number, such as by including a phone icon followed by the identified phone number or through display of a phrase such as "Call <number>", where the <number> is the identified phone number.

As mentioned above, the control unit 135 may be configured to identify other types of actionable content than phone numbers. For instance, the control unit 135 may be configured to identify an element of actionable content representing a web address. As an exemplary implementation, the control unit 135 may be configured to parse the metadata 115 to identify text representing a link to a web page, such as a universal resource locator (URL). The parsing may include, for example, searching the metadata 115 for an alphanumeric domain name string followed by a dot (.), further followed by a common top-level domain (TLD) or country code. Similar to the list of known false positive elements discussed above, the control unit 135 may be configured with a list of known common TLDs that may be stored in a memory device 145 of the control unit 135, such that the control unit 135 may determine whether a TLD is valid according to the list. Exemplary TLDs may include, ".com", ".org,", ".net", ".biz", and ".info", while exemplary country codes may include ".us", ".ca", ".mx", ".tv", and ".fm" alone or in combination with certain common second level domains (e.g., ".co.uk", ".on.ca").

To further verify the validity of an identified element as a web address, the control unit 135 may be configured to parse the identified element for additional URL information, such as subdomains identified by an alphanumeric string followed by a dot (.) immediately preceding the domain name, and subfolders identified by a forward slash or backslash followed by an alphanumeric string. As one example, the control unit 135 may be configured to accept up to two subdomains (e.g., www.cashin.SomeProductname.com) and up to six subfolders in an URL, but other maximum numbers of subdomains and subfolders are possible. As another possible URL validation, the control unit 135 may be configured to parse the identified element to validate a file extension included in the URL. As some examples, the control unit 135 may validate a file extension against a listing of accepted file extensions (e.g., ".htm", ".html", ".aspx") or against an acceptance heuristic such as a maximum number of file extension characters. The control unit 135 may be configured to tolerate up to one character of whitespace on either side of dots (.), slashes, backslashes, and question marks to address various potential inconsistencies in the specification of URLs in the metadata 115.

The control unit 135 may be configured to identify other types of actionable content as well. As one example, the control unit 135 may parse the metadata 115 to identify an element including a text string to be sent to an indicated destination number (e.g., a short code or valid phone number). Examples that may match such a type of actionable content may include phrases such as "text winner to 51595", or "To enter, text 'I want one too' to 12543 for your chance to win".

As another exemplary identifiable type of actionable content, the control unit 135 may parse the metadata 115 to identify a social media network address, such as a Twitter® handle beginning with an "@" symbol (e.g., @user1234). As yet a further example, the processor 140 may parse the metadata 115 to identify an e-mail address according to identification of an alphanumeric string followed by an "@" symbol and e-mail domain (e.g., user@gmail.com).

After the control unit 135 has identified an element of actionable content, the control unit 135 may generate an option 160 configured to allow the user to interact with the actionable content based on its identified type. For example, if the item of actionable content is a phone number, the option 160 may include a button to call the identified phone number. As additional examples, the option 160 may include a button to send a text message if the actionable content includes texting a message to an identified number, a button to post a message to a social media network address if the actionable content includes a social media address, a button to compose and send an e-mail if the actionable content includes an e-mail address, or a button to bookmark or link to a web address if the actionable content includes a URL. The options 160 that are generated may vary according to various factors. For example, certain options 160 may be unavailable while the vehicle system 100 is in motion, such as an option 160 to browse to an identified URL.

The display screen 155 may be configured to display information to a user. For example, the display screen 155 may be configured to display the metadata 115 as well as any generated options 160 created based on the elements of actionable content identified by the control unit 135. Exemplary display screens 155 may include an LCD screen, a touch screen, an array of LEDs or other segmented display, or other means for displaying a visual communication.

The vehicle system 100 may also include an audio subsystem 165 in communication with the control unit 135 and configured to receive media content 110 from the control unit 135 based on the media content 110 received in the radio data 105. The audio subsystem 165 may include a number of audio devices utilized in presenting various forms of audible communication, such as speakers, sub-woofers, amplifiers, and the like.

The vehicle system 100 may also include a keypad 170 in communication with the control unit 135 and configured to control various aspects of the control unit 135. The keypad 170 may be configured to input user selected data to the control unit 135 and indicate user selection of the option 160 displayed based on the identified element of actionable content. The user selected data input to the control unit 135 by the keypad 170 may include signals for other peripheral devices in communication with the control unit 135, such as the receiver 120 and audio subsystem 165. The keypad 170 may be configured to input the user selection of the radio station number, frequency, or network to the control unit 135 for which the receiver 120 will receive radio data 105 from. The keypad 170 may also be configured to input to the user selection of the level of the audio signal transmitted from the control unit 135 to the audio subsystem 165, such as the level of the volume. This may include the user selection to make a phone call, send a text message, send an e-mail, view a web address, or the like.

While the vehicle system 100 is described in terms of computer system for a vehicle, other examples are possible. For instance, the features of the control unit 135 described in the vehicle system 100 may be implemented by other types of device configured to receive radio data 105 or connect to a network, such as an MP3 player, a portable satellite radio or HD radio, computer, or laptop. The vehicle system 100 may also be configured to receive media content 110 from other sources such as internet radio or podcasts. For example, a smart phone or other media device capable of receiving media content 110 such as internet radio or podcasts may be configured to act as the receiver 120 and communicate the media content 110 and metadata 115 to the processor 140 through a Bluetooth® or Wi-fi connection. The vehicle system 100 may also be configured to receive media content 110 such as an MP3 file from a media storage device such as a USB hard drive connected directly to the vehicle system 100. For example, the user may uploaded a number of MP3 music files onto a USB drive and then connects the USB drive to the vehicle system 100 to play the music through the vehicle systems 100 audio subsystem 165.

Figure 2:
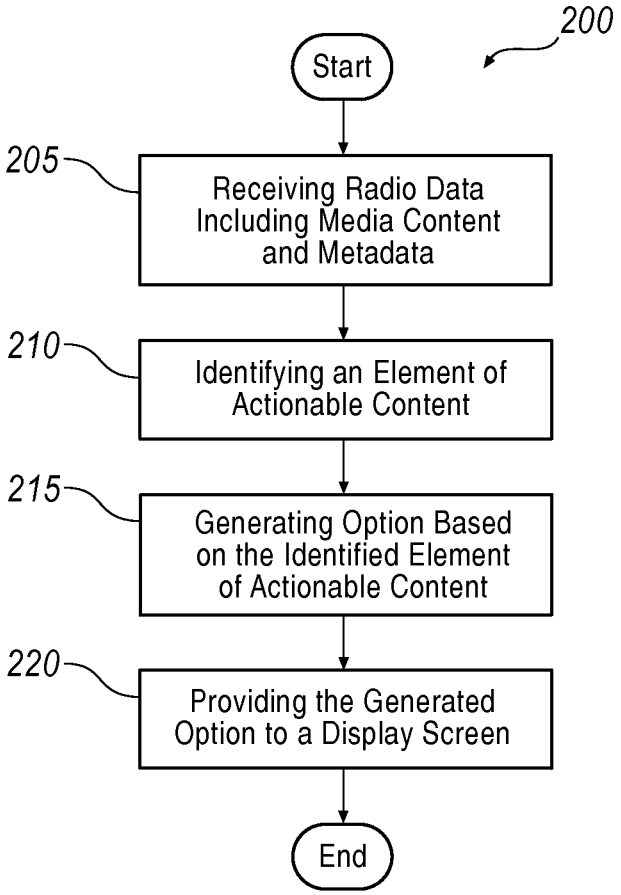
FIG. 2 illustrates a flowchart of the process for identifying actionable content included in radio data.

FIG. 2 illustrates a flow chart of an exemplary process 200 for identifying an element of actionable content included in radio data 105. The process 200 may be performed by various devices, such as by a control unit 135 executing a pattern recognition module 150.

At block 205, the vehicle system 100 receives radio data 105. For example, the receiver 120 may be configured to receive the radio data 105 from a transmitter 125. The radio data 105 may include media content 110 and metadata 115 descriptive of the media content 110. The media content 110 may include audio or video content and the metadata 115 may include tagged information descriptive of the media content 110 for presentation to a user experiencing the media content 110.

At block 210, the control unit 135 identifies an element of actionable content. For example, the control unit 135 may be configured to parse the metadata 115 included in the radio data 105 to identify elements of actionable contact. The control unit 135 identifies the element of the actionable content associated with a data type-specific user interface action based on parsing data fields of the metadata 115 tagged as including elements of data other than the actionable content. As some examples, the control unit 135 may be configured to identify an element as a phone number, a web page address, a text message, a social media network address, or an e-mail address.

At block 215, the control unit 135 generates an option 160 based on the identified element of actionable content. For example, if the element is identified as a phone number, the control unit 135 may be configured to generate an option 160 to allow the user to call, add to an address book, or otherwise interact with the phone number. As another example, if the element is identified as a web page address, the control unit 135 may generate an option 160 that when selected allows a user to browse to or bookmark the identified web page address. Additional details with respect to generation of options 160 are discussed below with respect to FIGS. 3 and 4.

At block 220, the control unit 135 provides the option 160 to a display screen 155. For example, the control unit 135 may be configured to provide the generated option 160 to the display screen 155 facilitating user interaction with the actionable content for selection by the user. The appearance of the generated option 160 may further provide context to the user with respect to the action available to be performed or the type of option 160 being presented (e.g., a phone icon for a phone number, an internet icon for a web page, etc.). Additional details with respect to the display of generated options 160 are discussed below with respect to FIG. 5. After block 220, the process 200 ends.

Figure 3A:
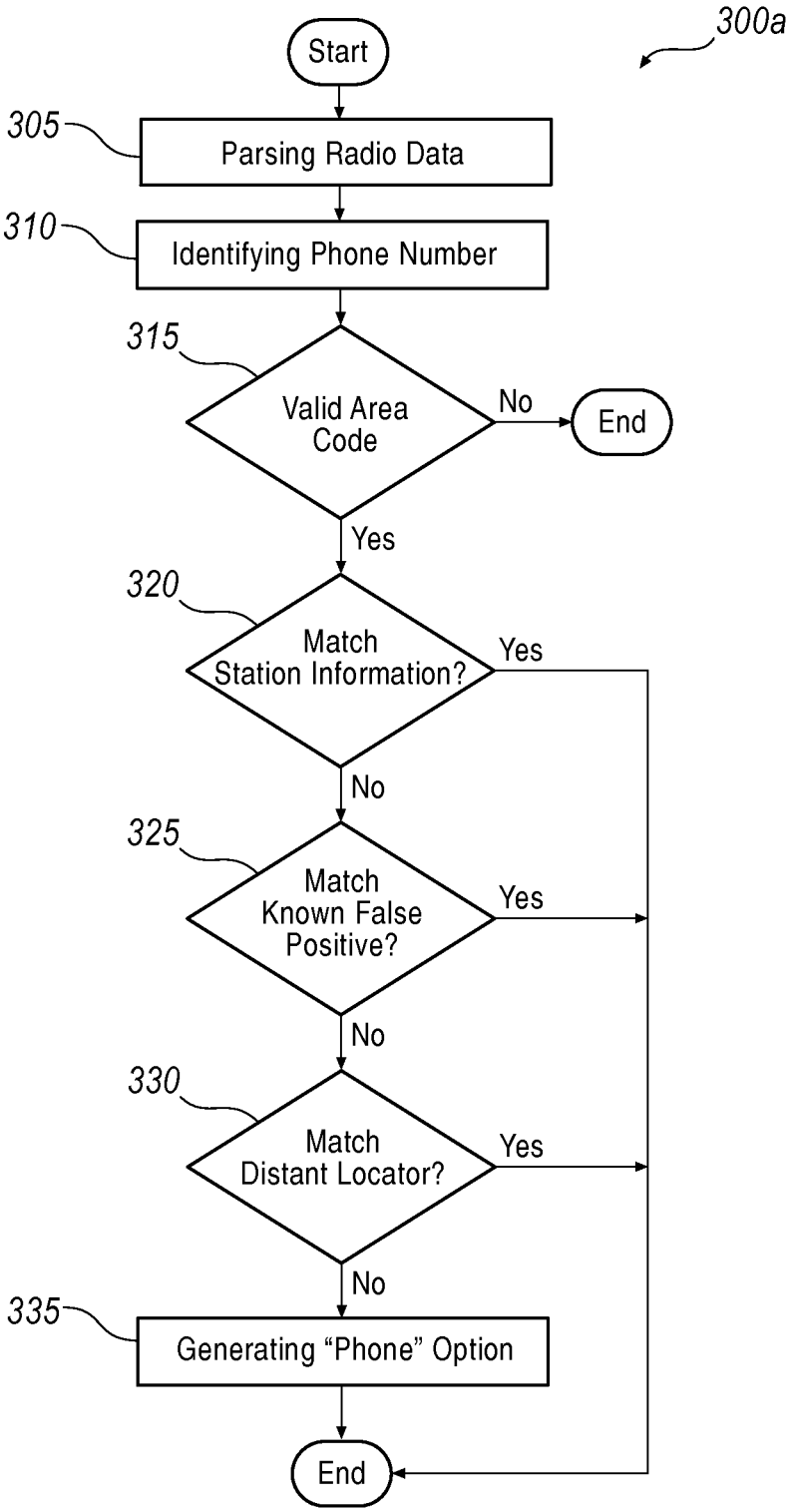
FIG. 3A illustrates a flowchart of the process for identifying a phone number as an element of actionable content included in radio data.

FIG. 3A illustrates flowchart of an exemplary process 300A for identifying a phone number as an element of actionable content included in radio data 105. As with the process 200, the process 300 may be performed by various devices, such as by a control unit 135 executing a pattern recognition module 150.

At block 305, the control unit 135 parses the metadata 115 included in the radio data 105 for an element of actionable contact representing a phone number. For example, the control unit 135 may parse a text string included in the metadata 115 for characters suggestive of a phone number, accounting for potential additional text before or after an otherwise valid phone number.

At block 310, the control unit 135 identifies an element of the actionable content as a potential phone number. For example, the control unit 135 may identify a string of three numbers that potentially represent an area code in a phone number. The identified string may further include seven numbers or a combination of at least seven numbers and letters, potentially including one or more grouping of digits and grouping separators.

At decision point 315, the control unit 135 determines whether the string of three numbers identified in block 310 is a valid area code. For instance, the control unit 135 may perform a comparison of the string of three numbers against a listing of valid North American Numbering Plan (NANP) area codes stored on the memory device 145. If the string is not identified as being a valid area code, the process 300A may end after block 315. If the string is determined to include a valid area code, the process 300A may proceed to decision point 320.

At decision point 320, the control unit 135 determines whether the phone number should be filtered out as including station information incorrectly identified as a phone number. For instance, the control unit 135 may compare the characters of the identified element against the radio frequency, station number, and/or radio station name on which it is being broadcast. As an example, the string "939 The River Radio" broadcast on 93.9 FM may be filtered out even though "939 The River" may otherwise meet the system criteria for matching a valid phone number, as numerals are likely representative of the radio station and not of a phone number. As another example, the string "877" broadcast on 87.7 FM may be allowed despite being the broadcast frequency, as "877" is a typical toll-free area code. If the phone number should be filtered out, the process 300A ends. Otherwise, the process 300A may proceed to decision point 325.

At decision point 325, the control unit 135 determines whether the phone number should be filtered out as including a known false positive string value. For example, the control unit 135 may compare the element of actionable content identified as a phone number against a list of known false positive string values stored in the memory device 145, such that if any of the known false positive string values are found in the element of actionable content, then that element may be filtered out. Exemplary false positive strings may include "939 The River Radio", "810 in NY City", and "867-5309/JENNY" as some non-limiting examples. The control unit 135 may be configured with an updateable list of known false positive elements that may be stored in a memory device 145 of the control unit 135. If the phone number should be filtered out, the process 300A ends. Otherwise, the process 300A may proceed to decision point 330.

At decision point 330, the control unit 135 determines whether the phone number should be filtered out as including a distant area code. For example, a control unit 135 may identify that a vehicle system 100 located near Detroit, Mich. may identify the numeric string "313" as a valid area code but may filter the numeric string "415" out, while a control unit 135 of a vehicle system 100 located near Seattle, Wash. may do the opposite. The determination of vehicle 100 location may be determined, for example, according to a vehicle system 100 GPS receiver. If the phone number should be filtered out, the process 300A ends. Otherwise, the process 300A may proceed to block 335.

At block 335, the control unit 135 generates a phone number option 160 based on the identified element of actionable content. For example, if the element is identified as a phone number, the control unit 135 may be configured to generate an option 160 that when selected calls the phone number and/or allows for adding the phone number to an address book. The generated phone number option 160 may further include content indicative of how the option 160 should be displayed, such as a phone icon followed by the identified phone number or an exemplary phrase such as "Call <number>", where the <number> is the identified phone number. After block 335, the process 300A ends.

Figure 3B:
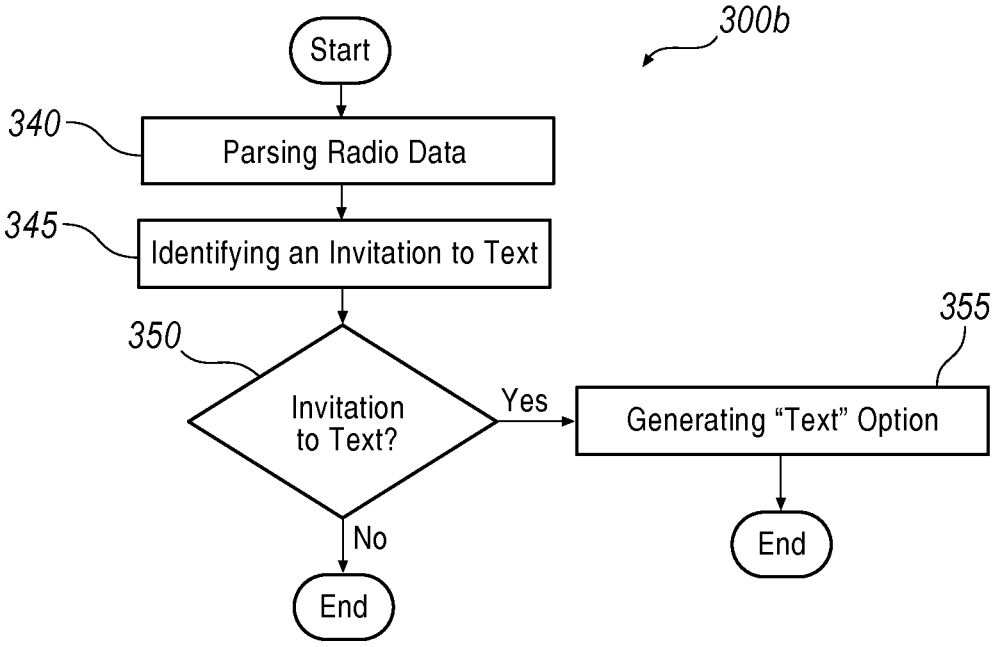
FIG. 3B illustrates a flowchart of the process for identifying an invitation to send a text message as an element of actionable content included in radio data.

FIG. 3B illustrates a flow chart of an exemplary process 300B for identifying an invitation to send a text message as an element of actionable content included in radio data 105. As with the processes 200 and 300A, the process 300B may be performed by various devices, such as by a control unit 135 executing a pattern recognition module 150.

At block 340, the control unit 135 parses the metadata 115 included in the radio data 105 for an element of actionable contact representing an invitation to send a text message. For example, the control unit 135 may parse a text string included in the metadata 115 for characters suggestive of an invitation to send a text message, accounting for a potential short code and key word to be included in the text message.

At block 345, the control unit 135 identifies an element of the actionable content as a potential invitation to send a text message. For example, the control unit 135 may identify an element including a text string to be sent to an indicated destination number (e.g., a short code or valid phone number). The identified string may further include a keyword or phrase to be included in the body of the text message.

At decision point 350, the control unit 135 determines whether the indicated destination number identified in block 310 is an invitation to send a text message. For instance, the control unit 135 may perform a comparison of the text string against a keyword or phrase indicative of an invitation to send a text message stored on the memory device 145. Examples that may match such a type of actionable content may include phrases such as "text winner to 51595", or "To enter, text 'I want one too' to 12543 for your chance to win". If the string is not identified as an invitation to send a text message, the process 300B may end after block 350. If the string is determined to include an invitation to send a text message, the process 300B may proceed to block 355.

At block 355, the control unit 135 generates a text message option 160 based on the identified element of actionable content. For example, if the element is identified as an invitation to send a text message, the control unit 135 may be configured to generate an option 160 that when selected composes a text message including the keyword or phrase included in the text string and addresses the text message to the identified destination number (e.g., a short code or valid phone number). The text message option 160 may further include content indicative of how the option 160 should be displayed, such as inclusion of a phrase such as "Text <phrase> to <number>", where the <phrase> is the identified keyword or phrase in the invitation to send a text message and the <number> is the short code (e.g., "Text winner to 51595"). After block 355, the process 300B ends.

Figure 4A:
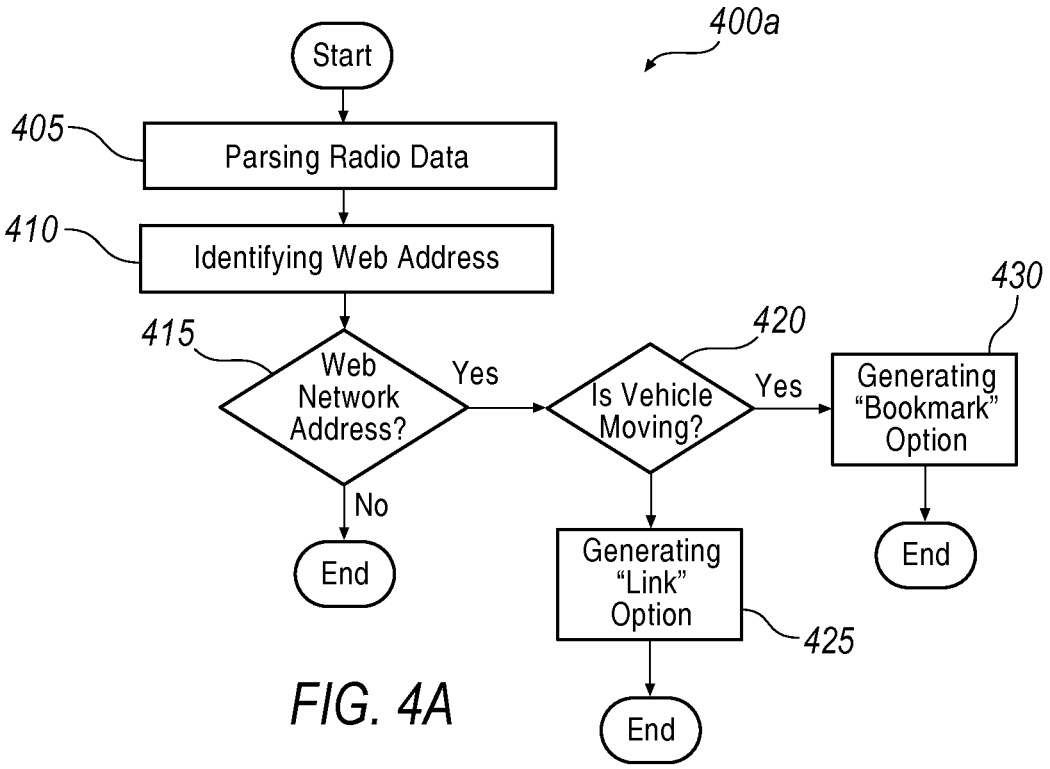
FIG. 4A illustrates a flowchart of the process for identifying a web address as an element of actionable content included in radio data.

FIG. 4A illustrates a flowchart of an exemplary process 400A for identifying a web address as an element of actionable content included in radio data 105. As with the processes 200 and 300A-B, the process 400A may be performed by various devices, such as by a control unit 135 executing a pattern recognition module 150.

At block 405, the control unit 135 parses the metadata 115 included in the radio data 105 for an element of actionable content representing a web address. For example, the control unit 135 may parse the text string included in the metadata 115 for characters common to a web address such as .com, http, www, etc.

At block 410, the control unit 135 identifies an element of actionable content representing a web address within the metadata 115 included in the radio data 105. For example, the control unit 135 may be configured to identify an element containing an alphanumeric string followed by a dot (.) and a common TLD or including a country code and valid secondary domain. Exemplary web addresses may include www.mydomain.com or www.mydomain.co.uk.

At decision point 415, the control unit 135 determines whether the element is a web address. If the control unit 135 determines that the element is a potential web address, the process may proceed to block 420. If the control unit 135 determines that the element is not a web address, the process 400A ends.

At decision point 420, the control unit 135 determines whether the vehicle system 100 is presently moving. If the control unit 135 determines that the vehicle system 100 is moving, the process 400A may proceed to block 430. If the control unit 135 determines that the vehicle system 100 is stationary, the process 400A may proceed to block 425.

At block 425, the control unit 135 generates a web option 160 based on the identified element of actionable content. For example, the control unit 135 may be configured to generate a web link option 160 that when selected navigates to the identified web address, or an option that when selected allows the user to bookmark the identified web address. The generated web option 160 may further include content indicative of how the option 160 should be displayed, such as an Internet icon followed by the identified web address, or a phrase such as "Link to <address>", where the <address> is the identified web address (e.g., www.mydomain.com). After block 425, the process 400A ends.

At block 430, the control unit 135 generates a web option 160 based on the identified element of actionable content. For example, the control unit 135 may be configured to generate a bookmark option 160 representing the identified web address, but not a web link option 160 because navigation to a web page may be disallowed due to the motion of the vehicle system 100. If the bookmark option 160 is selected by the user, the control unit 135 may be configured to bookmark the web address so that the user can connect to the web address after the vehicle system 100 has become stationary. The bookmark option 160 may further include content indicative of how the option 160 should be displayed, such as inclusion of a phrase such as "Bookmark <address>", where the <address> is the identified web address (e.g., www.mydomain.com). After block 430, the process 400A ends.

Figure 4B:
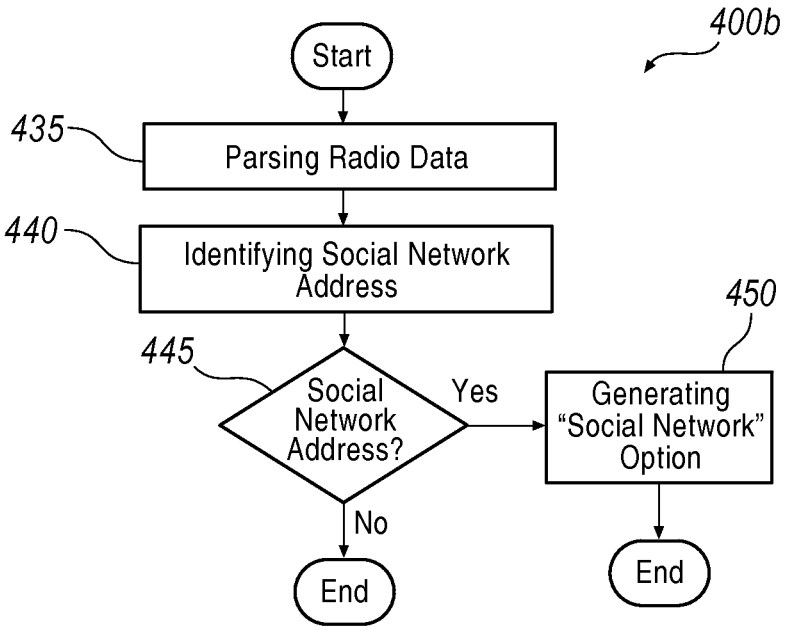
FIG. 4B illustrates a flowchart of the process for identifying a social media network address as an element of actionable content included in radio data.

FIG. 4B illustrates a flowchart of an exemplary process 400B for identifying a social media network address as an element of actionable content included in radio data 105. As with the processes 200 and 300A-B, the process 400B may be performed by various devices, such as by a control unit 135 executing a pattern recognition module 150.

At block 435, the control unit 135 parses the metadata 115 included in the radio data 105 for an element of actionable content representing a social media network address. For example, the control unit 135 may parse the text string included in the metadata 115 for characters common to a social media network address such as an "@" symbol, Twitter®, Facebook®, .com, http, www, etc.

At block 440, the control unit 135 identifies an element as a social media network address. For example, the control unit 135 may be configured to identify an element as a social media network address if the element contains a single word beginning with an "@" symbol.

At decision point 445, the control unit 135 determines whether the element is a social media network address. For example, if the element contains "@my name", it is likely a Twitter® account name and the control unit 135 may recognize the element as a social media network address. If the control unit 135 determines the element is a social media network address, the process 400B may proceed to block 450. If the control unit 135 determines the element is not a social media network address, the process 400B ends.

At block 450, the control unit 135 generates a social media network address option 160 based on the identified element of actionable content. For example, if the control unit 135 identifies an element as a social media network address, the control unit 135 may be configured to generate a social media network address option 160 representing the social media network address. The social media network address option 160 may be indicative of an action to post a message on the social media network address. If the social media network address option 160 is selected by the user, the control unit 135 may be configured to post a message to the identified social media network address. The social media network address option 160 may further include content indicative of how the option 160 should be displayed, such as a phrase such as "Tweet at <social media>" where the <social media> may include a Twitter® account name. After block 450, the process 400B ends.

Figure 4C:
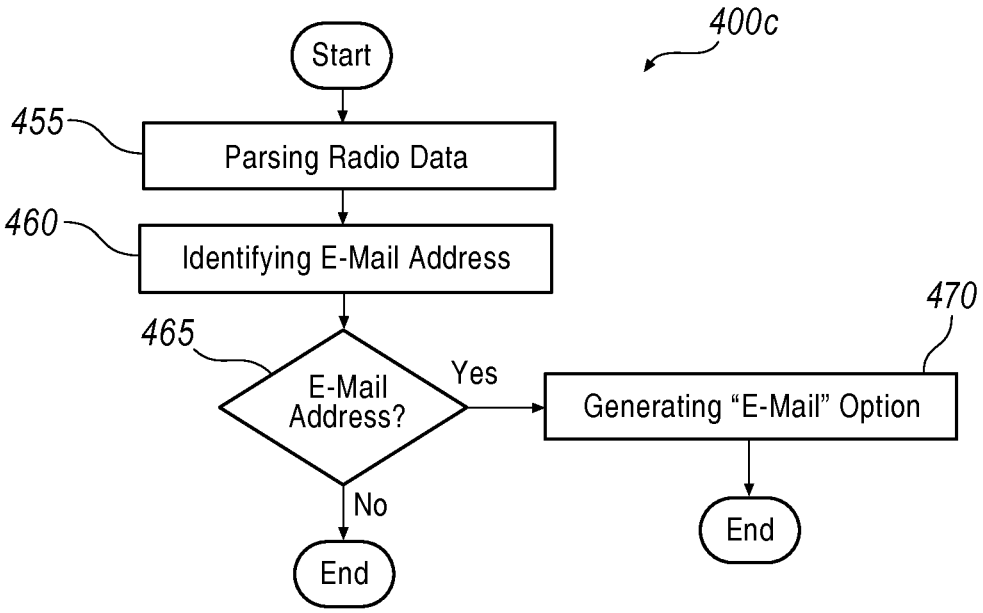
FIG. 4C illustrates a flowchart of the process for identifying an e-mail address as an element of actionable content included in radio data.

FIG. 4C illustrates a flowchart of an exemplary process 400C for identifying an e-mail address as an element of actionable content included in radio data 105. As with the processes 200 and 300A-B, the process 400C may be performed by various devices, such as by a control unit 135 executing a pattern recognition module 150.

At block 455, the control unit 135 parses the metadata 115 included in the radio data 105 for an element of actionable content representing an e-mail address. For example, the control unit 135 may parse the text string included in the metadata 115 for characters common to an e-mail address such as an "@" symbol, yahoo.com, gmail.com, .edu, etc.

At block 460, the control unit 135 identifies an e-mail address. For example, the control unit 135 may be configured to identify an element as an e-mail address, wherein the element contains an alphanumeric string followed by an "@" symbol and e-mail domain.

At decision point 465, the control unit 135 determines whether the element is an e-mail address. For example, if the element contains "@gmail.com", the element is likely a Google® e-mail account and the control unit 105 may recognize the element as an e-mail address. If the control unit 135 determines the element is an e-mail address, the process 400C may proceed to block 470. If the control unit 135 determines the element is not an e-mail address, the process 400C ends.

At block 470, the control unit 135 generates an e-mail address option 160 based on the identified element of actionable content. For example, if the control unit 135 identifies an element as an e-mail address, the control unit 135 may be configured to generate an e-mail address option 160 representing the identified e-mail address. The e-mail address option 160 may be indicative of an action to compose and send an e-mail. If the e-mail address option 160 is selected by the user, the control unit 135 may be configured to allow the user to enter a message and send it to the identified e-mail address. The e-mail address option 160 may further include content indicative of how the option 160 should be displayed such as an indication of a letter icon or the phrase "Compose e-mail to <address>" where the <address> is the identified e-mail address. After block 470, the process 400C ends.

Figure 5:
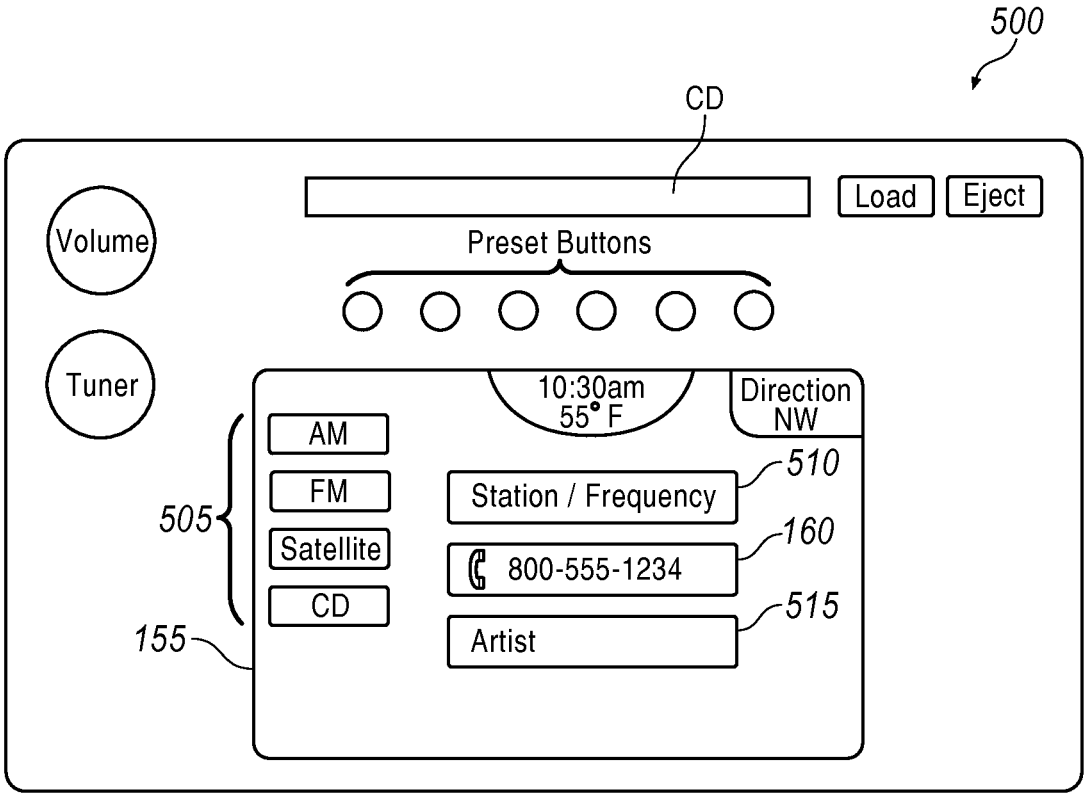
FIG. 5 illustrates a diagram of an exemplary display screen for displaying an option generated by the control unit.

FIG. 5 illustrates an exemplary display system 500 including a display screen 155 configured to display an option 160 generated by the control unit 135. In FIG. 5, a display screen 155, displaying an option 160, a source field 505, a radio data frequency field 510, and an artist field 515 is shown The display screen 155 may be configured to display the option 160 based on the element of actionable content identified by the control unit 135. In the illustrated example, as the control unit 135 has identified an element as a phone number, the option 160 displayed on the display screen 155 includes a phone icon followed by the identified phone number. In some examples, the field in which the identified actionable content was found may be hidden if the option 160 is displayed. For example, if the phone number was identified in the title field, the title field may be hidden to avoid display of the same phone number content twice.

The display screen 155 may display other metadata 115 information descriptive of the media content 110. For example, the source field 505 may be configured to present the source of the radio data 105 to the user. The source of the radio data 105 may be from a terrestrial source such as AM/FM radio or a satellite source such as XM radio. The radio data frequency field 510 may be configured to present the terrestrial radio frequency or satellite radio station being received by the vehicle system 100 to the user. For example, if the user has selected frequency 93.9 FM, the display screen 155 may be configured to display a phrase such as "93.9" or "93.9 The River" in the radio data frequency field 510. The artist field 515 may be configured to present the data included in the metadata 115 that is tagged as "artist" to the user. For example, the radio data 105 may include metadata 115 descriptive of the artist of the media content 110 included in the radio data 105 and tagged as "artist." The display screen 155 may be configure to display the metadata 115 tagged as "artist" in the artist field 515.

In sum, the vehicle system 100 may be configured to identify elements of actionable content in metadata 115 of received radio data 105, and may provide options 160 in a display screen 155 user interface device to allow a user to interact with the actionable content. Thus, if a broadcaster chooses to include contact information in the metadata 115, the vehicle system 100 may be able to present the contact information to a user as an option 160 allowing the user to easily make use of the contact information.

While the vehicle system 100 is described in terms of computer system for a vehicle, other examples are possible. For instance, the features of the control unit 135 described in the vehicle system 100 may be implemented by other types of devices configured to receive radio data 105, such as an MP3 player, a portable satellite radio or HD radio, computer, laptop, smartphone or other type of media player. For example, a smart phone capable of receiving media content 110 such as internet radio or podcasts may be configured to act as the receiver 120 and communicate the media content 110 to the processor 140 through a Bluetooth® or Wi-fi connection. Another example may include a media storage device such as a USB hard drive capable of storing media content 110 such as MP3 or video files that may be accessed by the vehicle system 100 when connected to the processor 140.

In general, computing systems and/or devices, such as the vehicle system 100, may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OS X and iOS operating systems distributed by Apple Inc. of Cupertino, Calif., the BlackBerry OS distributed by Research In Motion of Waterloo, Canada, and the Android operating system developed by the Open Handset Alliance.

Computing devices generally include computer-executable instructions, where the instructions may be executable by one or more computing devices. Computer-executable instructions may be compiled or interpreted from computer programs created using a variety of programming languages and/or technologies, including, without limitation, and either alone or in combination, Java™, C, C++, Objective C, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A media content processor comprising:

a control unit programmed to locate contact information included in metadata fields descriptive of received media content; and a display screen programmed to display the metadata fields, and when contact information is located in a metadata field, further display a user interface option, in association with the metadata field, indicating a contact information type-specific option to be performed using the located contact information when the metadata field is selected.

2. The media content processor of claim 1, wherein the media content processor is installed in a vehicle.

3. The media content processor of claim 2, wherein the user interface option is disabled when the vehicle is moving.

4. The media content processor of claim 1, wherein the metadata fields include at least one of an artist field and a title field.

5. The media content processor of claim 1, wherein the contact information includes at least one of a telephone number, a short code, an e-mail address, a web address and a social media network address.

6. The media content processor of claim 5, wherein the control unit is further configured to locate the contact information by verifying that an area code of the telephone number is valid without dialing the telephone number.

7. The media content processor of claim 5, wherein the control unit is further configured to locate the contact information by parsing the metadata to match at least one of a string of alphanumeric characters followed by a dot (.) and a common top-level domain, a phrase including a message body and a short code, a single word beginning with an "@" symbol, and a string of alphanumeric characters followed by an "@" symbol and a common domain.

8. The media content processor of claim 7, wherein the control unit is further configured to:

compare the contact information against a list of known false-positive values including one or more song titles, radio station identifications, or radio show titles; and filter the contact information as being an invalid element of contact information when a false-positive string value is a match to the contact information.

9. The media content processor of claim 1, further comprising an audio subsystem configured to play back the media content.

10. The media content processor of claim 9, wherein the audio subsystem is configured to present the media content to the user based on an audio signal received from the control unit.

11. The media content processor of claim 1, further comprising a keypad configured to receive user input.

12. The media content processor of claim 11, wherein the keypad is configured to receive user selection of the option.

13. The media content processor of claim 1, wherein the element of contact information is a telephone number, and the selectable user interface options associated with the respective title or author data fields is a telephone icon.

14. The media content processor of claim 1, further comprising a receiver programmed to receive the radio data including the media content and the metadata descriptive of the media content.

15. A method comprising:

receiving, at a processor, radio data including media content and metadata descriptive of the media content;

identifying an element of contact information by parsing metadata fields of the metadata tagged as including elements of data other than the contact information; and displaying the metadata fields, such that an artist field or a title field of the metadata including the contact information is displayed with an option indicating a contact information type-specific action to be performed to initiate a communication using the contact information when the option is selected.

16. The method of claim 15, further comprising generating the option based on the contact information.

17. The method of claim 15, further comprising receiving user selection of the option, and performing the contact information type-specific action.

18. The method of claim 15, wherein generating the option includes determining whether a vehicle in which the processor is included is moving.

19. The method of claim 18, further comprising disabling the option when the vehicle is moving.

20. The method of claim 15, wherein the contact information includes at least one of a telephone number, a short code, an e-mail address, a network address, and a social media network address.

21. A non-transitory computer-readable medium embodying computer executable instructions that, when executed by a processor, cause the processor to perform operations comprising:

parsing media content and metadata included in received radio data;

determining whether an element of contact information has been received based on parsing one or more artist or title data fields of the metadata;

displaying the one or more artist or title data fields; and displaying an option with the one or more artist or title data field indicative of a data type-specific action to be performed to initiate communication using the located contact information.

22. The computer-readable medium of claim 21, the instructions further comprising:

receiving updated radio data including media content and metadata;

re-parsing the data fields of the metadata tagged as including an element of data other than the contact information; and updating display screen with the option indicative of the data type-specific action to be performed based on the identified element of the contact information.

23. The computer-readable medium of claim 21, the instructions further comprising:

determining whether a user has selected the displayed option indicative of a content specific action to be performed based on the identified element of the actionable content.

* * * * *